US007704050B2

(12) United States Patent
Marioni

(10) Patent No.: US 7,704,050 B2
(45) Date of Patent: Apr. 27, 2010

(54) IMMERSION PUMP EQUIPPED WITH A FLOAT CONTROL DEVICE

(75) Inventor: Elio Marioni, Dueville (IT)

(73) Assignee: Askoll Holding S.R.L. (IT)

( * ) Notice: Subject to any disclaimer, the term of this patent is extended or adjusted under 35 U.S.C. 154(b) by 839 days.

(21) Appl. No.: 10/568,040

(22) PCT Filed: Aug. 23, 2004

(86) PCT No.: PCT/EP2004/009405

§ 371 (c)(1),
(2), (4) Date: Sep. 22, 2006

(87) PCT Pub. No.: WO2005/019649

PCT Pub. Date: Mar. 3, 2005

(65) Prior Publication Data

US 2007/0172359 A1 Jul. 26, 2007

(30) Foreign Application Priority Data

Aug. 22, 2003 (IT) ..... MI2003A1662

(51) Int. Cl.
*F04B 49/04* (2006.01)

(52) U.S. Cl. ..... 417/40; 417/423.3; 417/36

(58) Field of Classification Search ..... 417/36, 417/40, 297.5, 423.3; 73/305; 340/618, 340/623

See application file for complete search history.

(56) References Cited

U.S. PATENT DOCUMENTS 3,316,845 A * 5/1967 Schumann ..... 417/40
3,464,358 A * 9/1969 Lind ..... 417/44.1
3,897,172 A * 7/1975 Hall ..... 417/40
4,275,995 A * 6/1981 Taylor ..... 417/40
4,345,879 A * 8/1982 Steiner ..... 417/40
5,257,911 A * 11/1993 Mota et al. ..... 417/423.3
5,297,939 A * 3/1994 Orth et al. ..... 417/40
5,324,171 A * 6/1994 Cook ..... 417/40
5,562,423 A * 10/1996 Orth et al. ..... 417/40
5,622,477 A * 4/1997 Orth et al. ..... 417/40
5,775,877 A * 7/1998 Genz ..... 417/41
5,833,437 A * 11/1998 Kurth et al. ..... 417/36
6,390,780 B1 * 5/2002 Batchelder et al. ..... 417/36

FOREIGN PATENT DOCUMENTS

DE 36 07 466 A1 9/1987
DE 198 30 416 C1 12/1999
EP 1 136 701 A1 9/2001
FR 2 767 875 A 3/1999

* cited by examiner

*Primary Examiner*—Devon C Kramer
*Assistant Examiner*—Peter J Bertheaud
(74) *Attorney, Agent, or Firm*—Akerman Senterfitt

(57) ABSTRACT

The present invention relates to a synchronous pump structure, particularly to an immersion pump (1) equipped with a float control device (3) and comprising a synchronous electric motor (2) with a permanent magnet rotor (8). The pump (1) is so structured that the float (16) of the control device (3) is incorporated in an envelope (11), externally associated with the body (15) of the pump (1). A sensor element (4) of the control device (3) housed in the pump body (15) in correspondence with the float (16) is also provided.

11 Claims, 6 Drawing Sheets

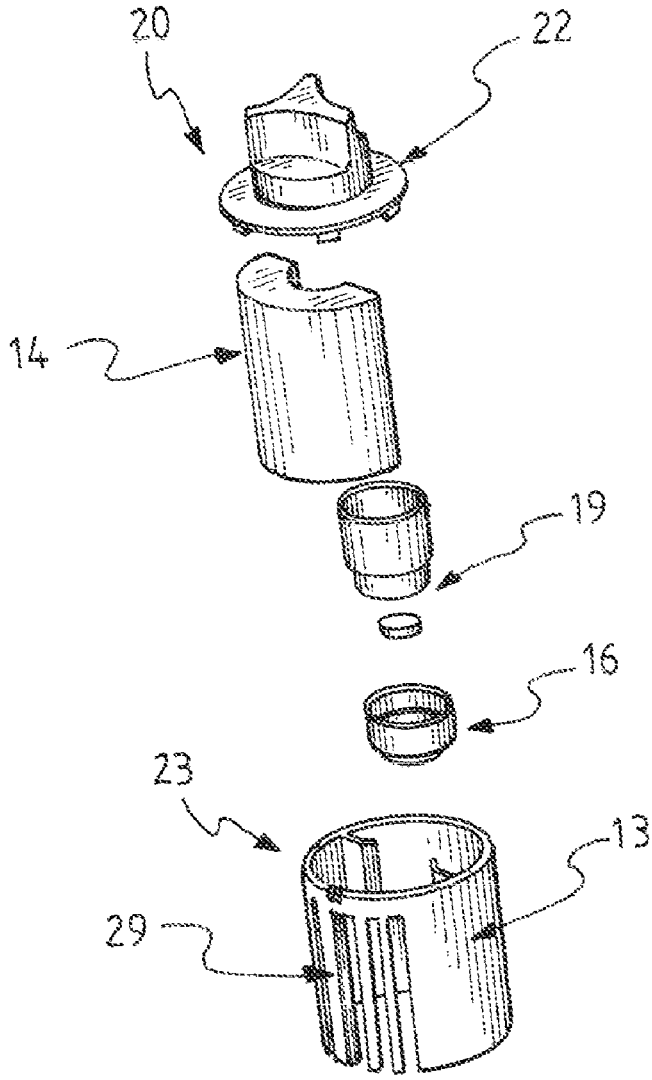
FIG.4
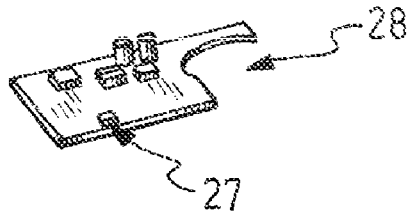

IMMERSION PUMP EQUIPPED WITH A FLOAT CONTROL DEVICE

FIELD OF APPLICATION

In its more general aspect the present invention relates to an immersion pump driven by a permanent-magnet synchronous electric motor and particularly, but not exclusively, suitable for a submersed installation in drain basins or tanks or in a sewage floodway.

More particularly, the invention relates to a synchronous pump structure, particularly an immersion pump equipped with a float control device and comprising a synchronous electric motor with a permanent-magnet rotor.

PRIOR ART

As it is well known to the skilled in the art, immersion pumps are used to rapidly pump down sewage collection tanks or however when fluids flowing in a recess are to be discharged, whose draining requires the fluid to exceed a given head.

A typical application in the civil field is represented by pumping down sewage collection basins or tanks positioned in underground rooms located at a lower level than the corresponding sewerage network.

Other applications occur in the building field for dumping down water-wells formed after digging for making foundations.

A float control device comprising a level sensor of the fluid to be discharged is generally associated to an immersion pump; the sensor allows the pump to be turned on when the fluid level is kept above a predetermined threshold and the pump to be turned off when the fluid level reaches a minimum value.

Such pumps are advantageously realized with permanent-magnet synchronous motors which are cheap and very reliable and they have the only drawback of a difficult turn-on due to the need to overcome the initial load inertia before reaching a steady synchronism state.

Several solutions can be adopted to remove this drawback by providing for example the use of convenient electronic driving circuits, or by providing an initial mechanical decoupling between the motor centre shaft and the pump impeller.

In any case, in synchronous immersion pumps the float control device, which is generally floating with respect to the pump body, is responsible for allowing the pump to be turned on or turned off.

These float control devices are not always capable to effectively adjust also the turn-off step, particularly when the pump starts the intake of the air having almost entirely drained the tanks wherein it is submersed.

More particularly, it often happens that, when little water is still to be discharged, continuous and following turns-on and turns-off can damage the pump control device and/or the pump itself.

A first aim of the present invention is to provide an immersion pump with a float control device incorporated in the pump body.

Another aim of the present invention is to provide an immersion pump with a float control device which can be adjusted by a user in order to select the different pump automatic and manual operating modes.

A further aim of the invention is to provide an immersion pump with a float control device having a simple construction and being reliable and low-cost.

SUMMARY OF THE INVENTION

These and other aims are obtained by a pump structure as previously indicated and characterized in that the float of said control device is incorporated in an envelope, externally associated with the pump body, and a sensor element of said control device is housed in the pump body in correspondence with said float.

The features and advantages of the pump structure according to the present invention will be apparent from the following description of an embodiment thereof given by way of non limiting example with reference to the attached drawings.

BRIEF DESCRIPTION OF THE DRAWINGS

FIG. 4 is a perspective exploded view of the float control device incorporated in the pump according to the invention;

DETAILED DESCRIPTION

Figure 5:
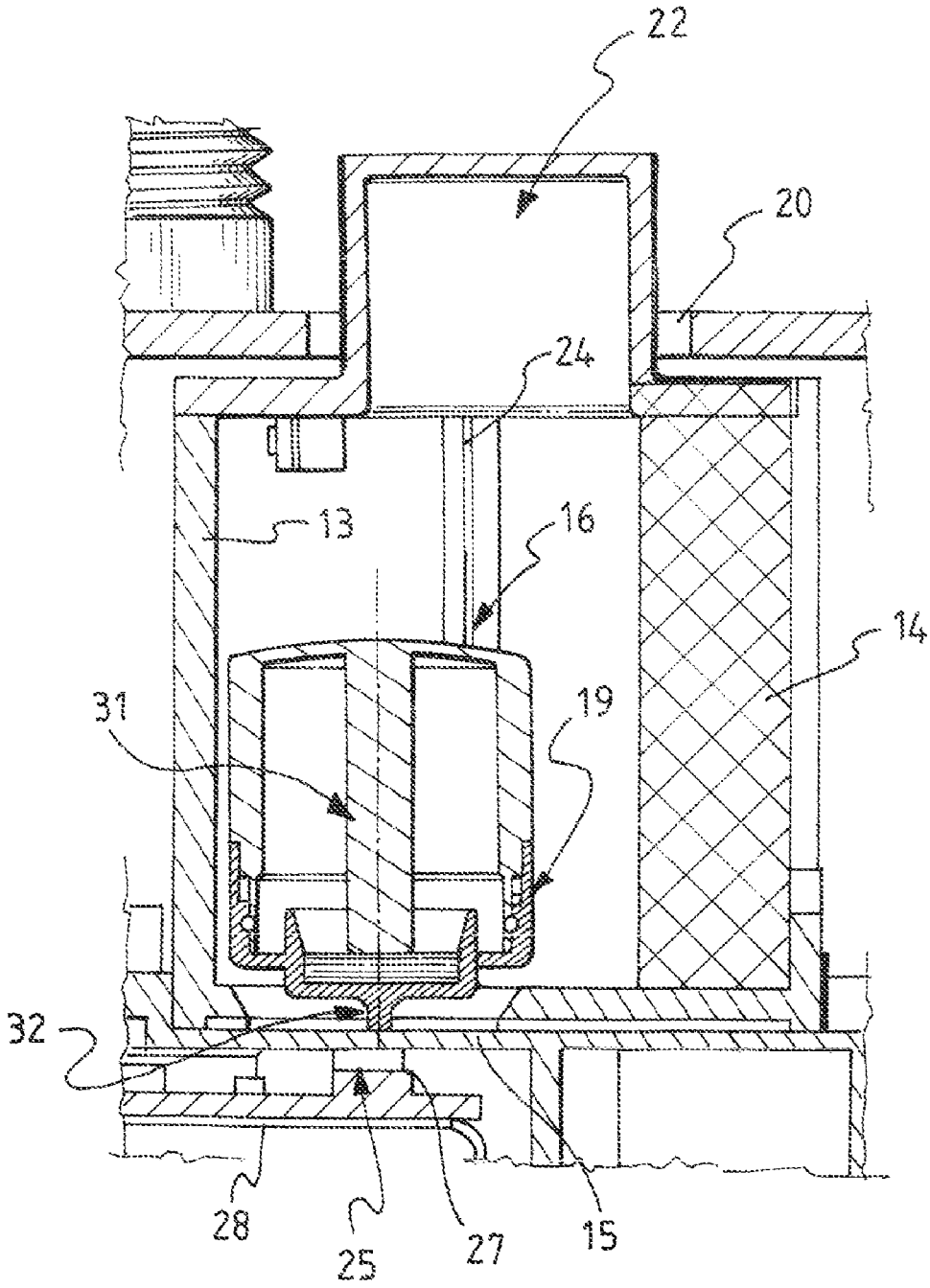
FIG. 5 is a schematic sectional view of a float control device incorporated in the pump structure according to the invention.

With reference to the figures, and particularly to the examples of FIGS. 4 and 5, a synchronous pump structure is globally and schematically indicated with 1, particularly an immersion pump installed in a submersed way in fluid collection basins or tanks.

The pump 1 has a substantially-truncated-cone-shaped body 15 being equipped in the upper part with a lid 18 covering a top portion 12 of the pump body 15.

The pump 1 is turned on by a synchronous electric motor 2 which can be both of the mechanical turn-on type and of the electronics-aided turn-on type.

Figure 1:
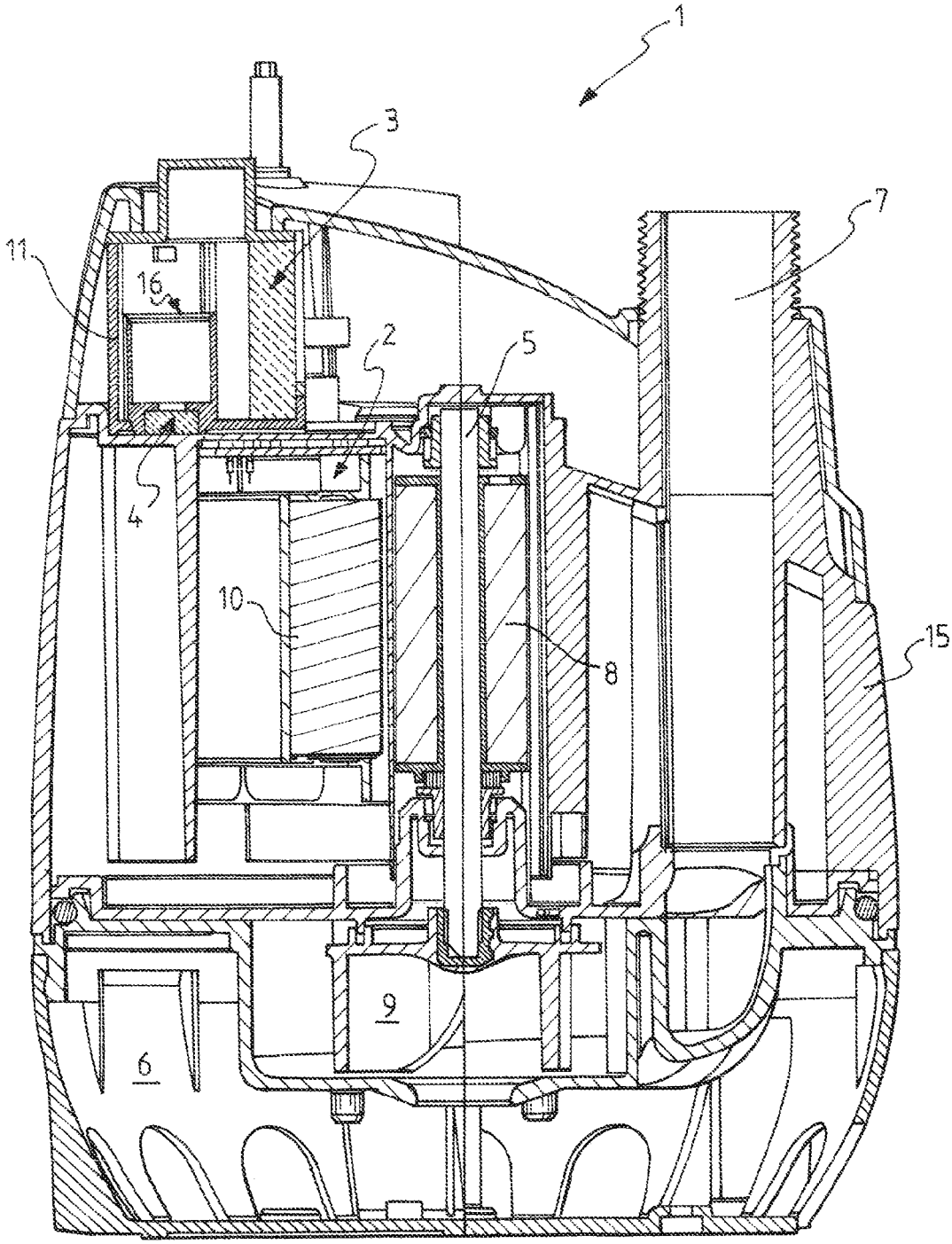
FIG. 1 is a vertical-section schematic view of a pump structure realized according to the present invention.
Figure 2:
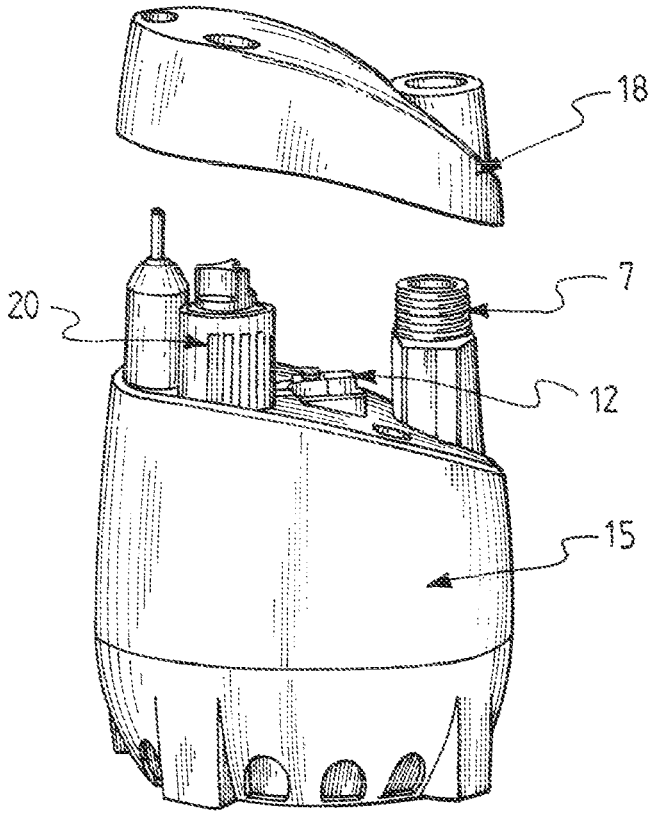
FIG. 2 is a perspective schematic view of a pump structure realized according to the present invention.
Figure 3:
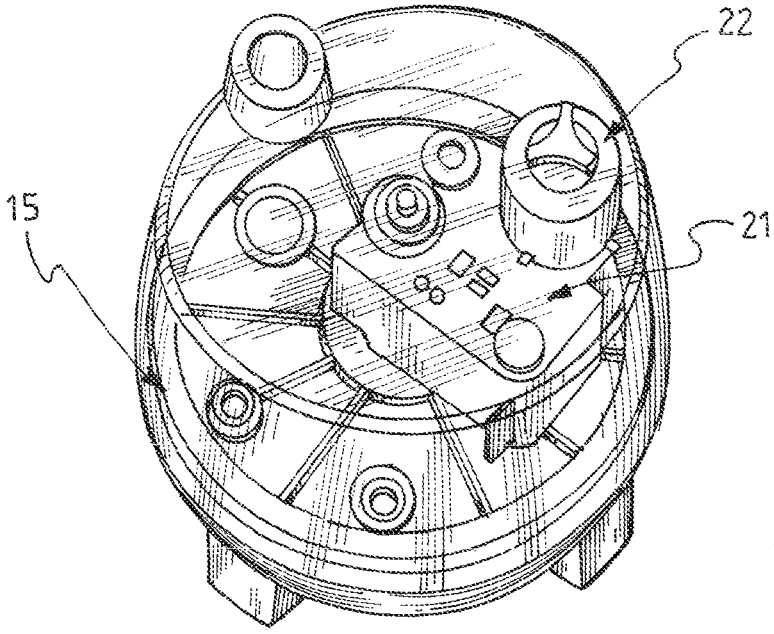
FIG. 3 is a perspective schematic look-through view of an upper portion of the pump of FIG. 2.

The electric motor 2 of the pump 1, shown in FIG. 1, comprises a stator 10 and a substantially cylindrical permanent-magnet central rotor 8. The motor 2 has an axis X-X substantially coinciding with the rotor 8 rotation axis.

The stator 10 comprises asymmetrical pole pieces shown in FIG. 1.

A shaft 5 of the motor 2, being integral with the rotor 8, has an end being kinematically connected with a pump impeller 9, which is housed in an intake chamber 6 located in the lower part of the pump 1 body.

The chamber 6 is in fluid communication with a waste duct 7 extending vertically and in a substantially parallel way with the motor 2 axis.

Figure 6:
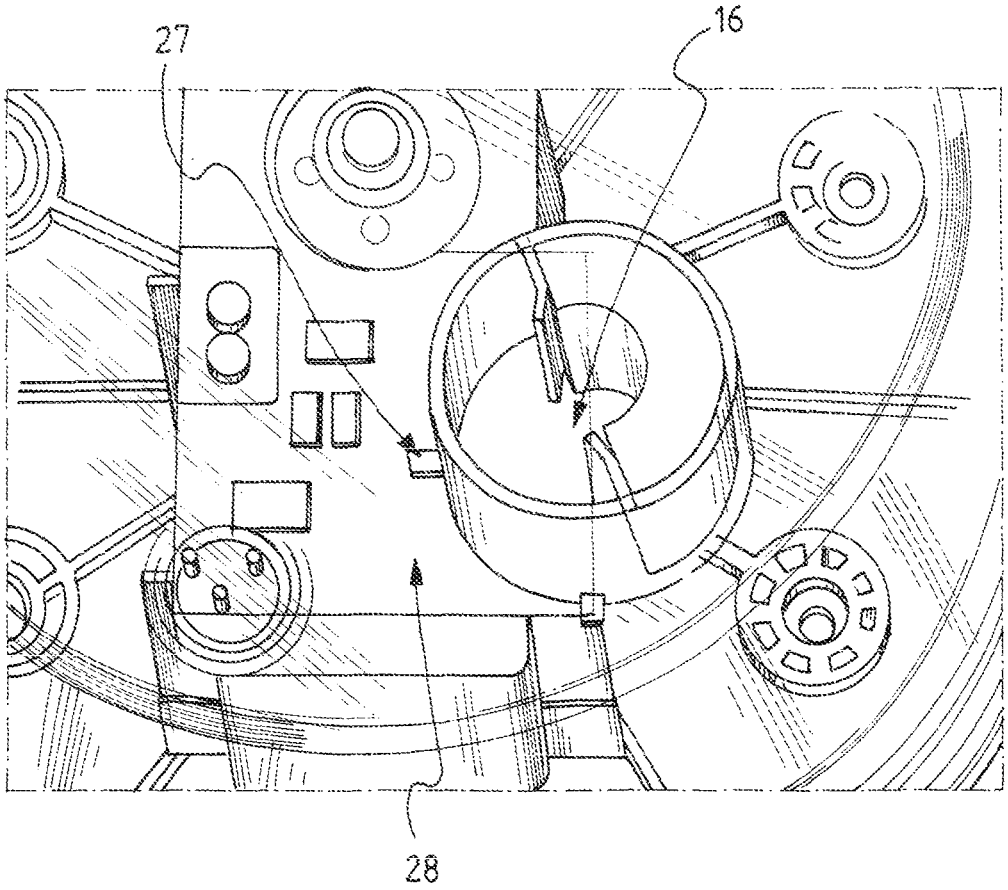
FIG. 6 is a schematic view from above of a first operating mode of the pump according to the invention.
Figure 7:
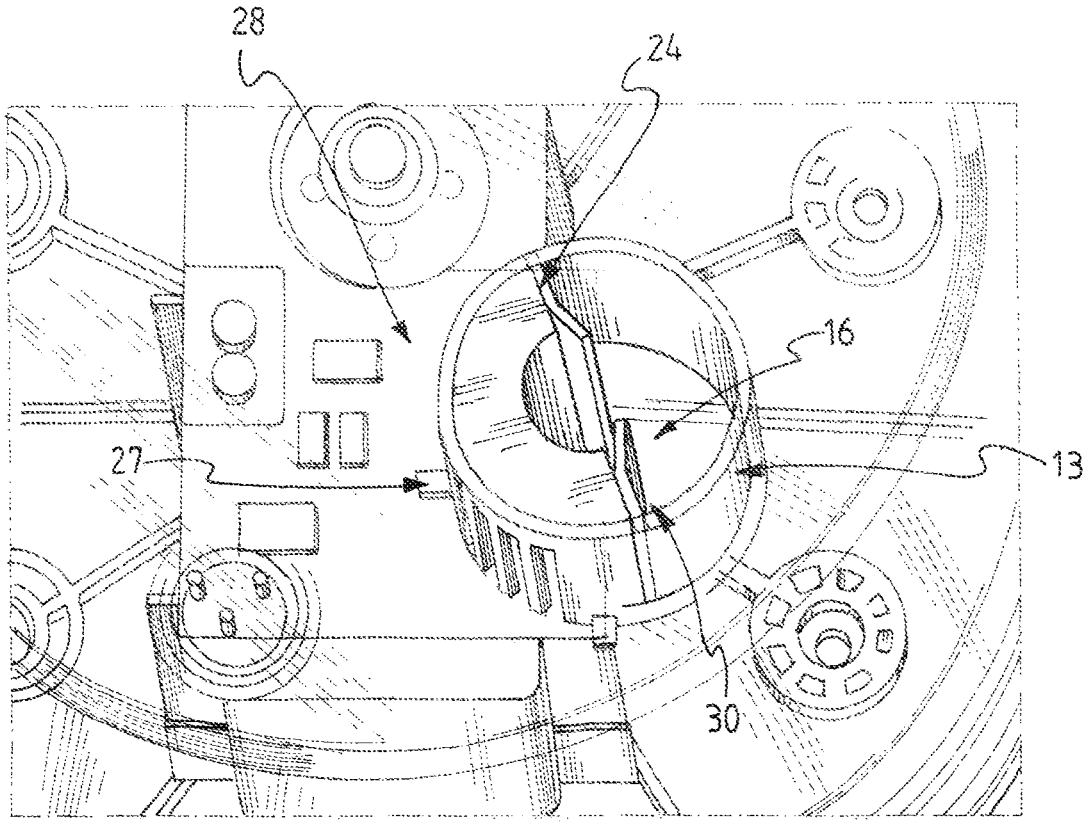
FIG. 7 is a schematic view from above of a second operating mode of the pump according to the invention.

The operation of the pump 1 is adjusted by an electronic turn-on and turn-off device, schematically shown in FIGS. 6 and 7 in the shape of components assembled on an electronic board 28 and interlocked with a float control device 3 realized according to the invention.

The control device 3 comprises a level sensor 4 of the fluid wherein the pump is submersed. This sensor 4 can be realized in several ways, for example: mechanical or electromechanical, optical, piezoelectric or radar.

However, according to the present invention, the sensor 4 is preferably of the Hall-effect magnetic type.

Advantageously, the control device 3 is housed in an envelope 11 located in the pump body upper part 12.

The envelope 11 comprises a substantially-cylindrical-cup-shaped base portion 13 rotary mounted on the pump body upper part 12.

The base 13 has a side portion 23 equipped with a grate 29 putting the internal part of the envelope 11 in fluid communication with the external environment. Internally, close to this side portion 23, a semi-cylinder-shaped filter element 14 is provided whose function will be explained hereafter. The filter 14 is kept in position by two opposite bulkheads 24, 30 partially projecting towards the internal part of the envelope 11.

A float 16 is housed inside the envelope 11.

The float 16 is formed by an hollow cylindrical plastic body and it is equipped in the lower part thereof with a permanent magnet 19. More particularly, this float 16 comprises a cup-shaped lower portion housing in the centre thereof the disk-or-button-shaped magnet 19. An upper cylinder-shaped portion closed in the upper end is pressingly fitted on the float lower portion, internally equipped with a central rod 31, axially extending, having a free end suitable for abutting against the magnet 19 in order to keep it in position.

The float 16 has in its lower part a bearing tip keeping it in a slightly rised position with respect to the base 13 bottom.

A lid 20 is fitted on the base 13 defining therewith a chamber of the envelope 11 wherein the float 16 can freely move in the portion being not occupied by the filter. The lid 20 has a knob 22 which can be handled by a user in order to adjust, with a predetermined angle amplitude, for example between 90° and 180°, the float 16 position on the horizontal plane.

More particularly, the float 16 can move freely in the chamber delimited by the two bulkheads 24, 30 being innerly formed in the base 13 and projecting inside the envelope 11.

The water inflow determining the float 16 movement is ensured by the grate-shaped wall 29 drawn in the side wall 23 of the base 13. The filter 14 is located within the grate-shaped wall 29 in order to prevent suspended bodies or other pollutants from contacting the float 16 and jeopardizing the free movement thereof.

An electronic board 28, suitable for housing the pump turn-on and turn-off electronic device, is advantageously housed within the pump body 15 in a position just underlying the float control device 3.

As it is well shown in FIG. 5, the board 28 is equipped at one end with a Hall probe 27 housed on a board surface in a position facing the permanent magnet 19 of the float 16.

However, the mobile position of the float 16 can provide a reciprocal separation and approach of the magnet 19 with the Hall probe 27, but also a misalignment of the probe 27 and the magnet 19, as it will be apparent in the following description.

An insulating resin layer 25 separates the board 28 from the internal wall of the pump body 15, just between the Hall probe and the magnet 19.

Moreover, also the upper wall of the pump body 15 insulates the Hall probe 27 and the magnet 19 so that all the live circuit parts have a double insulation with respect to the internal area of the envelope 11 containing water.

The two different operating modes of the pump 1 according to the invention will now be described according to the two different precise positions of the magnet 19 with respect to the Hall probe 27 of the control board 28:

A: Automatic Operation

The vertical axis of the float 16 coincides with the Hall probe 27 axis.

The float 16, when the pump is not completely submersed, abuts against the upper wall of the pump body 15 and thus the probe 27 feels the magnet 19.

When the water level rises raising the float 16, the permanent magnet 19 exits from the sensitivity range of the Hall probe 27 and the control device 3 allows the pump 1 to be turned on.

When the water level decreases, the float 16 goes back in the rest position, the Hall probe 27 feels once again the magnet 19 and the control device 3 emits a consent signal to turn the pump 1 off.

The pump turn-off thus occurs when two conditions simultaneously occur:

float at rest;

possible air in the impeller chamber.

B: Manual Operation

The vertical axis of the float 16 does not coincide with the Hall probe 27 axis so that the probe 27 never detects the magnet 19.

This situation is interpreted by the control device 3 as the pump being always submersed and thus always moving even with air in the impeller chamber.

From the previous description it evidently results how the float control device according to the invention allows the immersion pump to be effectively driven avoiding vacuum operation situations.

The so-equipped pump is more compact and it substantially incorporates a function being previously required by external components.

By the pump structure according to the invention a collection basin of the fluids to be discharged is also not required, since the pump can perfectly operate comprising all the necessary components.

Obviously, also the further advantage of a lower manufacturing cost of the whole pump derives from the previous advantages.

The invention claimed is:

1. A synchronous immersion pump equipped with a float control device and comprising a synchronous electric motor with a permanent-magnet rotor, wherein the float of said control device is incorporated in a chamber of an envelope externally associated with the body of the pump, said envelope comprising a base rotary mounted on said body and a sensor element of said control device housed in said body in correspondence with said base, said float reciprocates freely inside said chamber in a separation and approach relationship with said sensor element in response to a fluid level, wherein said sensor has a central vertical axis, and wherein the float may or may not reciprocate along said axis depending on the position of said base.

2. A pump structure according to claim 1, wherein said sensor element is a level sensor of the Hall-effect magnetic type.

3. A pump structure according to claim 1, wherein said float is equipped with a permanent magnet in its lower part.

4. A pump structure according to claim 1, wherein said envelope comprises said base and a lid; wherein said base comprises a cylindrical-cup-shaped portion, and wherein said lid and said base define said chamber.

5. A pump structure according to claim 4, wherein the lid comprises a knob which can be handled by a user to adjust the position of the float on the horizontal plane.

6. A pump structure according to claim 2, wherein said Hall effect sensor comprises a probe mounted on an electronic board housed in the pump body in a position underlying the float.

7. A pump structure according to claim 4, wherein said base portion has a side wall equipped with a grate to put the internal part of the envelope in fluid communication with the external environment.

8. A pump structure according to claim 7, wherein a semi-cylinder-shaped filter element is provided on the internal side of said grate.

9. A pump structure according to claim 8, wherein said filter is kept in position by two opposite bulkheads partially projecting towards the internal part of the envelope.

10. A pump structure according to claim 2, wherein the position of the float can be manually adjusted in order to be misaligned with respect to said sensor element.

11. A pump structure according to claim 1, wherein said envelope is located in an upper part of said pump body.

* * * * *